US006318138B1

(12) United States Patent
Mathews et al.

(10) Patent No.: US 6,318,138 B1
(45) Date of Patent: Nov. 20, 2001

(54) REMOTELY CONTROLLED DOOR LOCK

(76) Inventors: Kurt Mathews, 4010 Sablegrove Ct., Houston, TX (US) 77014; Rainer Kuenzel, P.O. Box 824, Hunt, TX (US) 78024

( * ) Notice: Subject to any disclaimer, the term of this patent is extended or adjusted under 35 U.S.C. 154(b) by 0 days.

(21) Appl. No.: 09/440,819

(22) Filed: Nov. 15, 1999

(51) Int. Cl.[7] ..... E05B 47/06

(52) U.S. Cl. ..... 70/278.7; 70/279.1; 70/283; 292/144; 292/150

(58) Field of Search ..... 70/278.7, 279.1, 70/283; 292/144, 150

(56) References Cited

U.S. PATENT DOCUMENTS

| | | | | |
|---|---|---|---|---|
| 655,476 | * | 8/1900 | Carleton | 70/277 |
| 1,361,317 | * | 12/1920 | Dulczewski et al. | 292/144 X |
| 1,833,572 | * | 11/1931 | Hardesty | 292/DIG. 3 X |
| 3,751,088 | * | 8/1973 | Schlage et al. | 292/201 |
| 4,262,350 | * | 4/1981 | Inoue | 368/67 |
| 4,412,356 | * | 10/1983 | Klaus et al. | 359/147 |
| 4,669,283 | * | 6/1987 | Ingenhoven | 292/144 X |
| 4,762,350 | * | 8/1988 | Hurtado | 292/259 R |
| 4,902,053 | * | 2/1990 | Hakkarainen et al. | 292/144 |
| 4,904,005 | * | 2/1990 | Frolov | 292/144 X |
| 4,926,664 | * | 5/1990 | Gartner et al. | 70/119 |
| 5,083,448 | * | 1/1992 | Karkkainen et al. | 70/277 |
| 5,473,922 | * | 12/1995 | Bair et al. | 292/144 X |
| 5,715,715 | * | 2/1998 | Nunez | 70/283 |
| 5,920,268 | * | 7/1999 | Bucci et al. | 70/280 X |
| 5,943,888 | * | 8/1999 | Lawson | 70/278.7 |
| 5,983,739 | * | 11/1999 | Feder | 70/280 X |
| 6,035,676 | * | 3/2000 | Hudspeth | 70/278.1 |

FOREIGN PATENT DOCUMENTS

| | | | | |
|---|---|---|---|---|
| 10446 | * | 1/1903 | (AT) | 292/144 |
| 57484 | * | 7/1911 | (CH) | 292/144 |
| 176394 | * | 3/1922 | (GB) | 292/144 |
| 1342729 | * | 1/1974 | (GB) | 292/144 |
| 352014000 | * | 2/1977 | (JP) | 70/279.1 |

* cited by examiner

*Primary Examiner*—Lloyd A. Gall
(74) *Attorney, Agent, or Firm*—Bracewell & Patterson, L.L.P.

(57) ABSTRACT

A door lock which can be operated electrically, remotely, or mechanically using a lever or a key. The lock utilized a blocking bar which engages or disengages a notch in a locking latch. When the blocking bar is engaged within the notch, the latch is positioned in a strike plate of a door frame thereby locking the door. When disengaged, the latch can be retracted from the strike plate thereby allowing the door to be opened.

15 Claims, 6 Drawing Sheets

REMOTELY CONTROLLED DOOR LOCK

BACKGROUND OF THE INVENTION

1. Field of the Invention

The present invention relates generally to a door lock, and more particularly to a door lock for controlling access into a room or building with a portable remote controller.

2. Background of the Related Art

Various remotely controlled door locking devices have been developed over the years to more securely, efficiently, and easily control access to various structures. Typically, electrically actuated door locks require door preparation to install lock, in addition to installation of other components to complete a remotely activated system. Other components include an on-off system switch, a momentary release switch, a request to exit device, a power transformer to convert 110 volt ac current to required operating voltage, as well as wiring connected to join all of the components. Such devices are most often added after completion of the structure to meet changed or increased security needs. Providing the installation of components and necessary wiring to connect these components is often a significant portion of the cost to the purchaser.

Examples of remotely controlled security devices and related locks are described in the following U.S. Pat. No. 4,762,350 to Hurtado, U.S. Pat. No. 5,083,448 to Karkkaincn et al., U.S. Pat. No. 4,262,504 to Inoue, U.S. Pat. No. 4,412,356 to Klaus et al, and U.S. Pat. No. 4,926,664 to Gartner et al.

The '350 patent discloses a remotely controlled electric door locked having a tubular housing affixed to a door between a pair of securing brackets positioned on either side of the door opening frame. Electric motors within the housing move slide members into and out of engagement with the securing brackets. Installation of the lock is somewhat time intensive and securing brackets must be in proper alignment.

The '448 patent discloses a locking device that is mounted within a cavity in a door, thus is relatively difficult to install requiring formation of such cavity. As well as being mechanically complex, guiding and centralizing of latch and bolt relative to respective receiving member is crucial.

The '504 patent discloses an electric locking system that is also manually operable. The lock is mounted in a cavity in the door opening frame and wall of structure, requiring an involved installation procedure.

The '356 patent discloses a locking system that is remotely operable by a transmitter generating a light beam to unlock the door. Such transmitting devices are commonly known as "line of sight" transmitters. In other words, transmitter must be pointed directly at receiver to activate mechanism.

The '664 patent disclosed a safe door lock which incorparates a bolt which is moved into and out of a gate notch in a bar. With the bolt retracted from the gate notch thereby freeing the bar to move, pivots and levers cooperate with the movement of the bar to operate two latches which cooperate with corresponding pairs of strike plates in the door frame. In other words, the bolt is positioned to lock or unlock the bar. The bar, when unlocked, is then operated manually to move a pair of latches to open or close the door.

3. Objects and Advantages

In response to these deficiencies in the prior art, it is an object of the present invention to provide a remotely controlled door lock that installs in a much easier and faster manner than current methods.

It is a further object to provide such a door lock that is electrically operated and also capable of manual operation from either side of the door without electrical power.

Another object is to simplify the electromechanical components as much as practical by incorporating a locking bar which interacts directly with the latch of the door thereby providing the desired locking and unlocking action.

It is a still further object to provide such a door lock that requires no external wiring of any kind for remotely controlled operation.

SUMMARY OF THE INVENTION

The objects described above, as well as other objects and advantages are achieved by a remotely operated door lock that includes foremost a lock housing that is easily mounted to an inner face of door adjacent the edge. A spring biased latch being beveled on two faces is moveable along a linear path as defined by lock housing between extended and retracted positions. Means are mounted within lock housing for moving a latch blocking bar by electrical power into or out of a path perpendicular to latch, thereby blocking or allowing latch to retract into housing, locking or unlocking the door. Means are further disposed in the lock housing for manually urging the latch blocking bar out of the path of latch, independent of electrical moving means. Means are also disposed in the lock housing for receiving a wireless energy signal and controlling the operation of electric moving means with a control signal triggered by the wireless energy signal. Portable means are provided independently of lock housing for transmitting the wireless energy signal to the receiving and controlling means. A latch receiving member is provided for mounting to the door opening frame for engaging the spring latch to urge it to its retracted position as the door is being closed, and receiving latch in its extended position when the door is fully closed. The electrical power supply is a suitable battery with an on-off switch disposed between the battery and receiving and controlling means for opening and closing the circuit.

BRIEF DESCRIPTION OF THE DRAWINGS

In the drawings, wherein like reference characters are used throughout to describe like parts.

DETAILED DESCRIPTION OF THE PREFERRED EMBODIMENTS

FIGS. 1–7 illustrate a preferred embodiment of a remotely operated door lock, generally referred to as a door lock 9.

Figure 1:
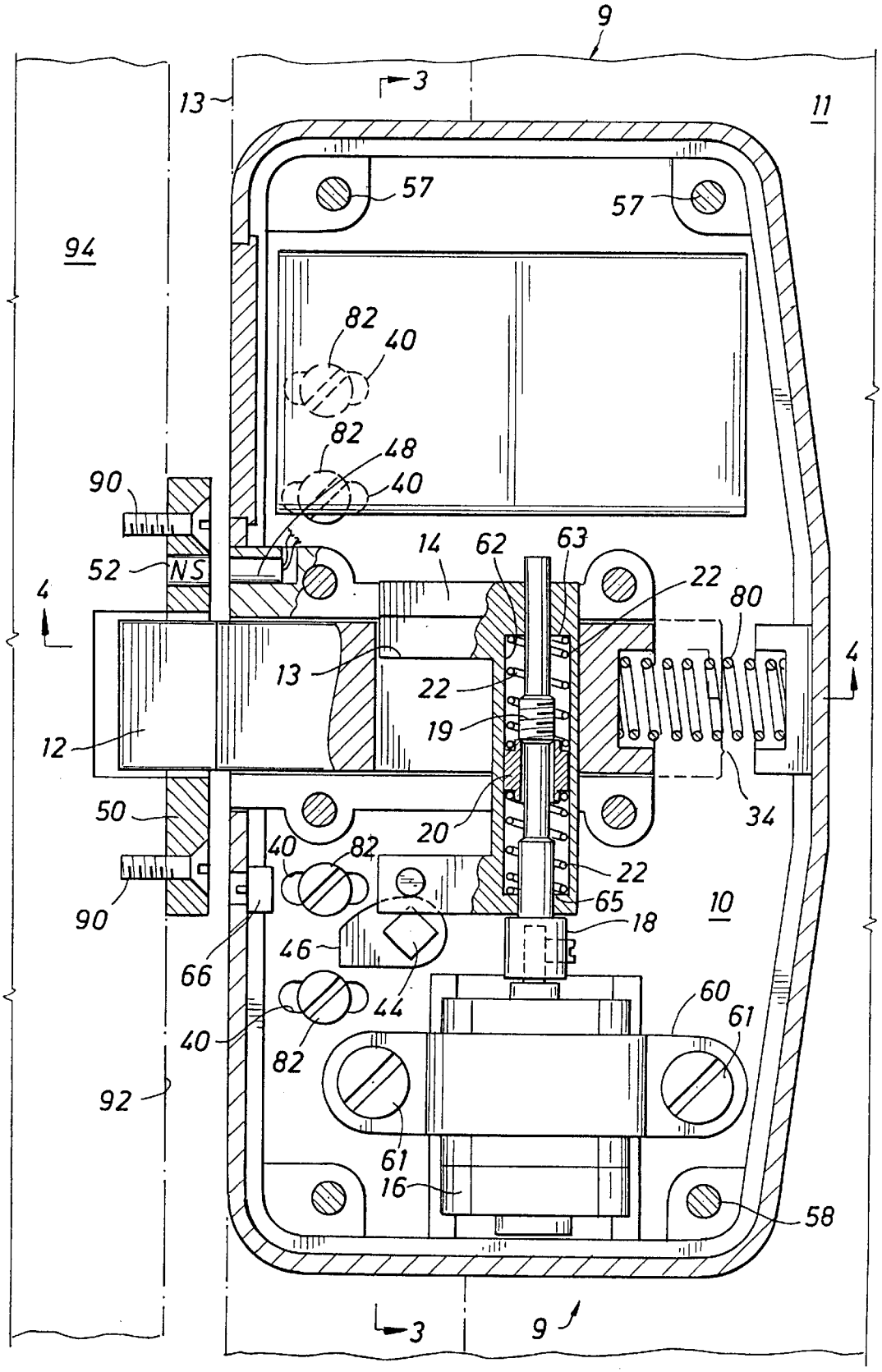
FIG. 1 is an elevation view of a remotely controlled door lock mounted on the face of a door in accordance with the present invention, having a spring latch in an extended position within a latch receiving member and a latch blocking bar engaged within square notch in latch, blocking retraction of latch into housing thereby locking door.

FIG. 1 is an elevation view of a door lock 9 mounted on an inner face 11 of a door. As shown in FIG. 1, the door lock 9 contains the parts to control movement of a latch 12 and a latch blocking bar 14. The door lock 9 includes foremost a lock base plate 10 for mounting to the inner face 11 of the door adjacent the door edge 13. The lock 9 is surface mounted on the door face 11 by screws 82 that are set in the door within longitudinal openings 40 in the base plate 10. The openings 40 permit the lateral positioning of the base plate 10 to be set as desired for proper engagement of the latch 12 with a latch receiving member, commonly referred to as a strike plate 50. The strike plate 50 is surface mounted with screws 90 set in a face 92 of a door opening frame 94. Similar longitudinal openings in the strike plate 50 further facilitate guiding and centralizing of engagement with the latch 12.

Still referring to FIG. 1, the base plate 10 contains the latch 12 which is biased by a spring 80 and predisposed to the extended position that is moveable along a linear path as defined by a control housing 34. Control housing 34 is the central point of the control of the latch 12 by movement of the blocking bar 14 in a path perpendicular to the latch 12 within control housing 34. Engagement of the blocking bar 14 into the rectangular notch 13 in the latch 12 prevents retraction of the latch 12 into the control housing 34, thereby locking the door.

Figure 2:
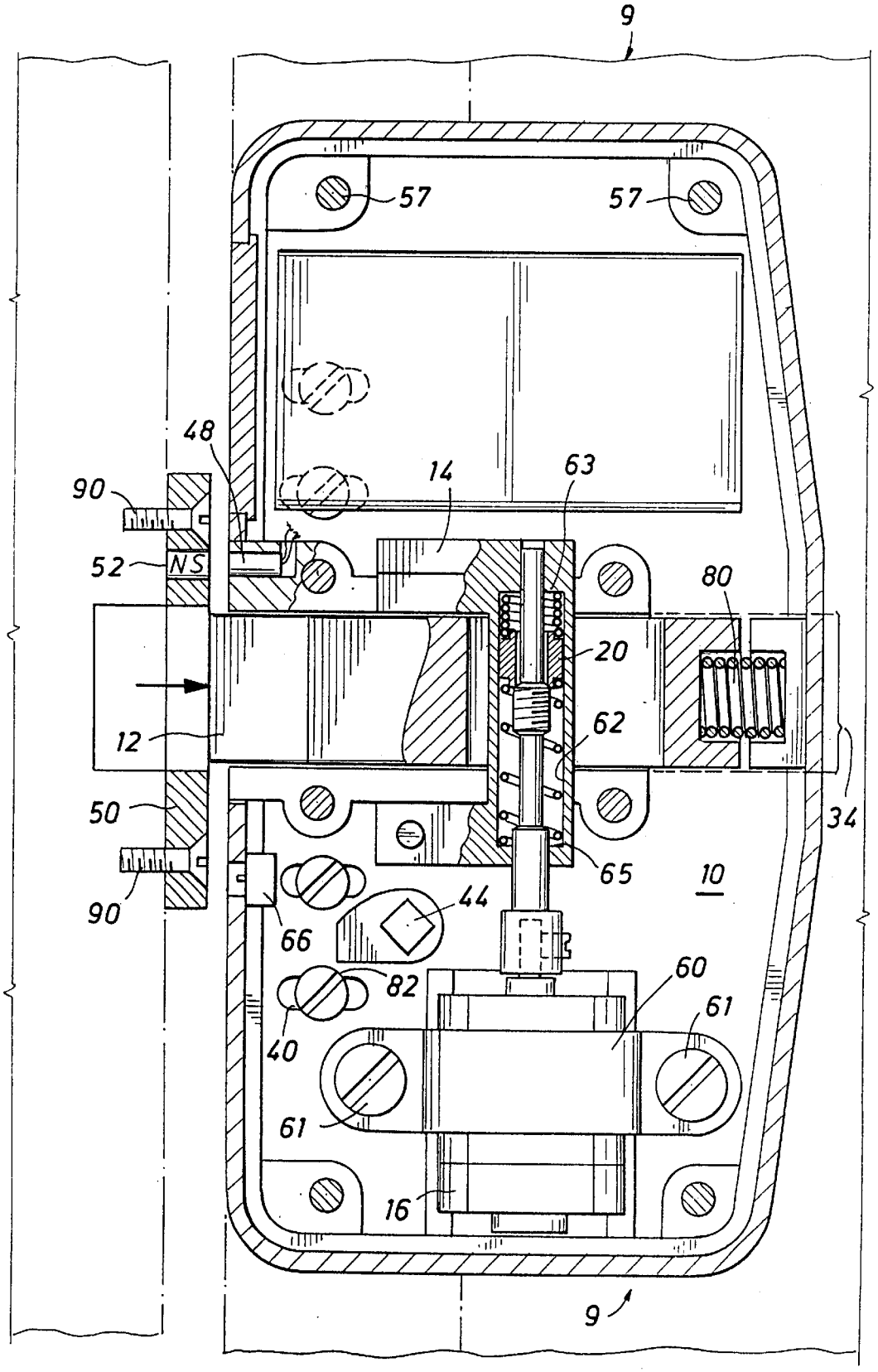
FIG. 2 is similar to FIG. 1 with blocking bar disengaged from square notch in latch allowing retraction of latch into housing, unlocking door.

FIG. 2 is an elevation view similar to FIG. 1 showing the door unlocked. Referring to FIG. 2 for the moment, the blocking bar 14 is moved upwardly thereby disengaging the notch 13 in the latch 12. The latch 12 can then move to the right into the control housing 34 as shown in FIG. 2, disengage the strike plate 50, and thereby unlock the door. Disengagement of blocking bar 14 from rectangular notch in latch 12 permits retraction of latch 12 into control housing 34, unlocking the door.

Figure 4:
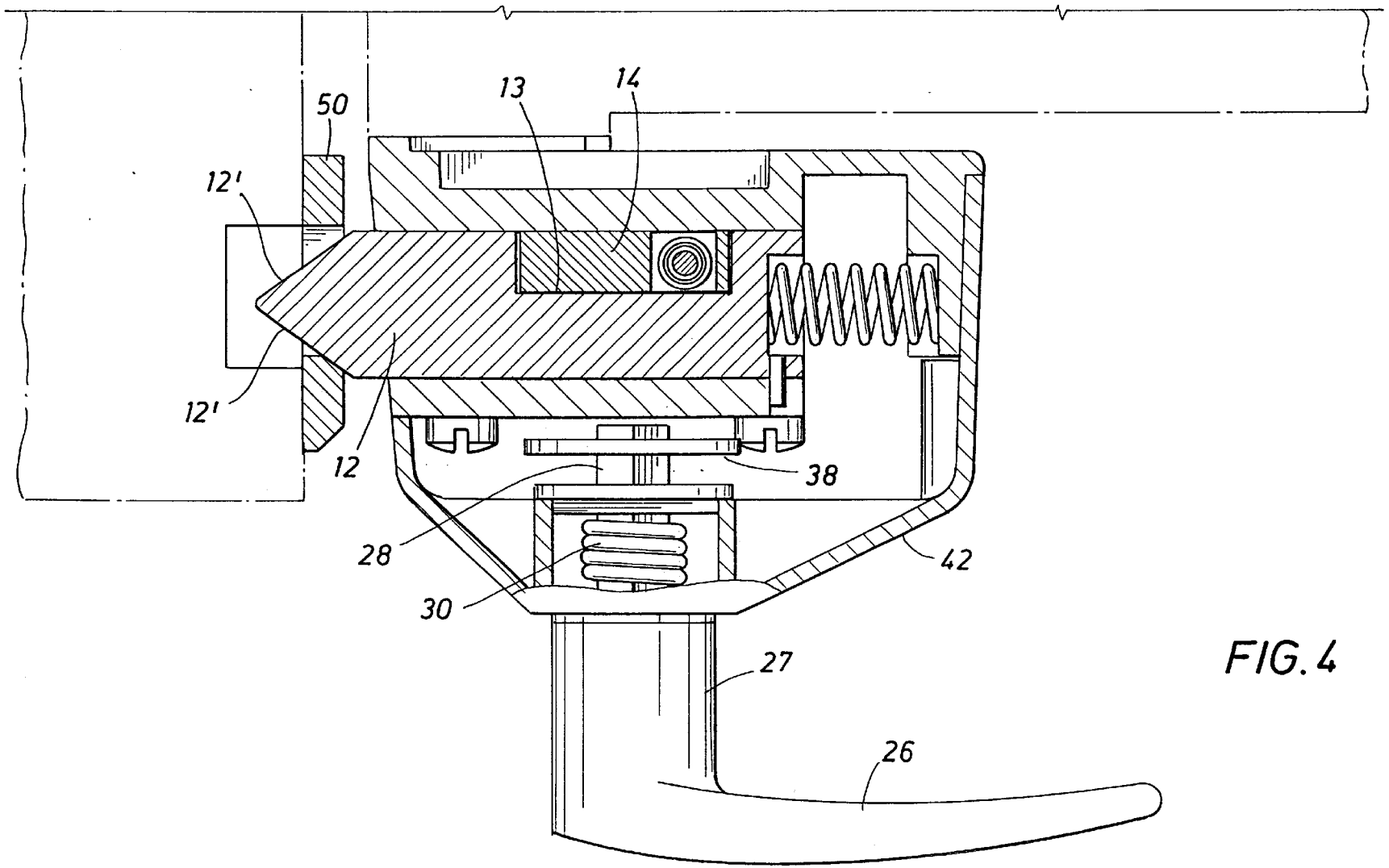
FIG. 4 is a top view of the remotely controlled lock with latch extended into latch receiving member, and latch blocking bar engaged with square notch in latch, this being the locked condition.
Figure 5:
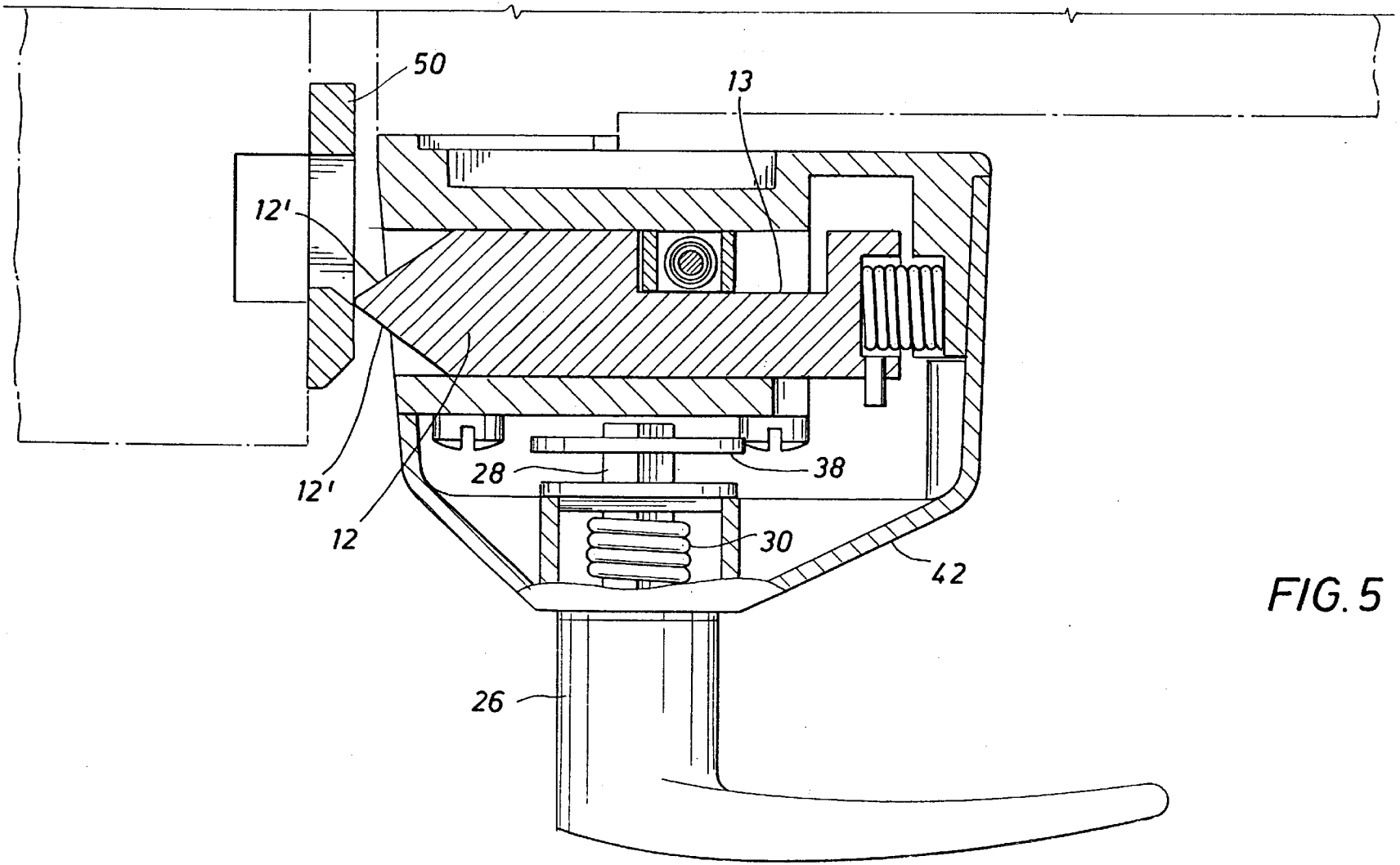
FIG. 5 is a top view of the remotely controlled lock with latch blocking bar disengaged from square notch in latch, allowing latch to retract into housing as door is being opened.

FIGS. 4 and 5 are top views of the lock 9. FIGS. 1 and 4 illustrate the blocking bar 14 engaged with the rectangular notch 13 (see FIG. 1) of the latch 12 thereby blocking retraction of the latch 12 into control housing 34 and therefore locking the door. FIGS. 2 and 5 illustrate the blocking bar 14 disengaged from the rectangular notch 13 in the latch 12, permitting retraction of the latch 12 into the control housing 34 thereby unlocking the door. Using this movement, only a small amount of energy is required to shift and maintain lock 9 to either locked or unlocked condition.

FIGS. 4 and 5 illustrate another important feature of the lock 9, namely the cooperative action of the latch 12, the blocking bar 14, the notch 13 and the striker plate 50. As shown in FIGS. 4 and 5, retraction of the latch 12 into the control housing 34 is urged by the action of strike plate 50 on either of the beveled surface 12' of latch 12. The latch 12, being beveled on two faces 12', permits retraction into the control housing 34 as door is being opened or closed when the blocking bar 14 is disengaged from rectangular notch 13 in latch 12. Stated another way, the door can be freely opened or closed without turning any lever, or door knob, or the like when the door is "unlocked" by withdrawing the blocking bar 14 from the notch 13 in the latch 12.

ELECTRICAL OPERATION OF THE LOCK

Referring now to FIGS. 1 and 2, the base plate 10 further includes means connected therein for moving the blocking bar 14 under electrical power between positions of engagement and disengagement in relation to the rectangular notch 13 in the latch 12. The moving means preferably includes an electric motor 16 connected to the base plate 10 via screws 61 that extend through a motor bracket 60 for securing the motor 16 to base plate 10. The electric motor 16 produces torque that rotates an output shaft 18 upon receipt of a control signal from a receiving and controlling circuit as described further below. The central portion of output shaft 18 is externally threaded with threads 19 and positioned on the centerline of a longitudinal opening 62 in the blocking bar 14. A nut 20, having internal threads and engaging the shaft threads 19, is positioned axially within opening 62 about centerline of output shaft 18 such that their respective threads are in engagement. The nut 20 is in slidable engagement within the walls of the opening 62 and is prevented from rotating relative to the blocking bar 14.

A pair of helical springs 22 are disposed in the opening 62 on opposing sides of nut 20 and ends 63 and 65 of opening 62 to transfer forces applied to the nut 20 via the respective threads to the blocking bar 14. Rotation of output shaft 18 induces a linear movement of the nut 20 within the longitudinal opening 62, urging the springs 22 to move the blocking bar 14 along a linear and vertical path as defined by the control housing 34. In other words, the combination of the output shaft 18, the nut 20, the helical springs 22, and the motor 16 form an electric moving means for positioning the blocking bar 14 between the position of engagement and disengagement of the rectangular notch 13 in the latch 12. Hereafter, these elements will be referred to simply as "electrical moving means".

Figure 3:
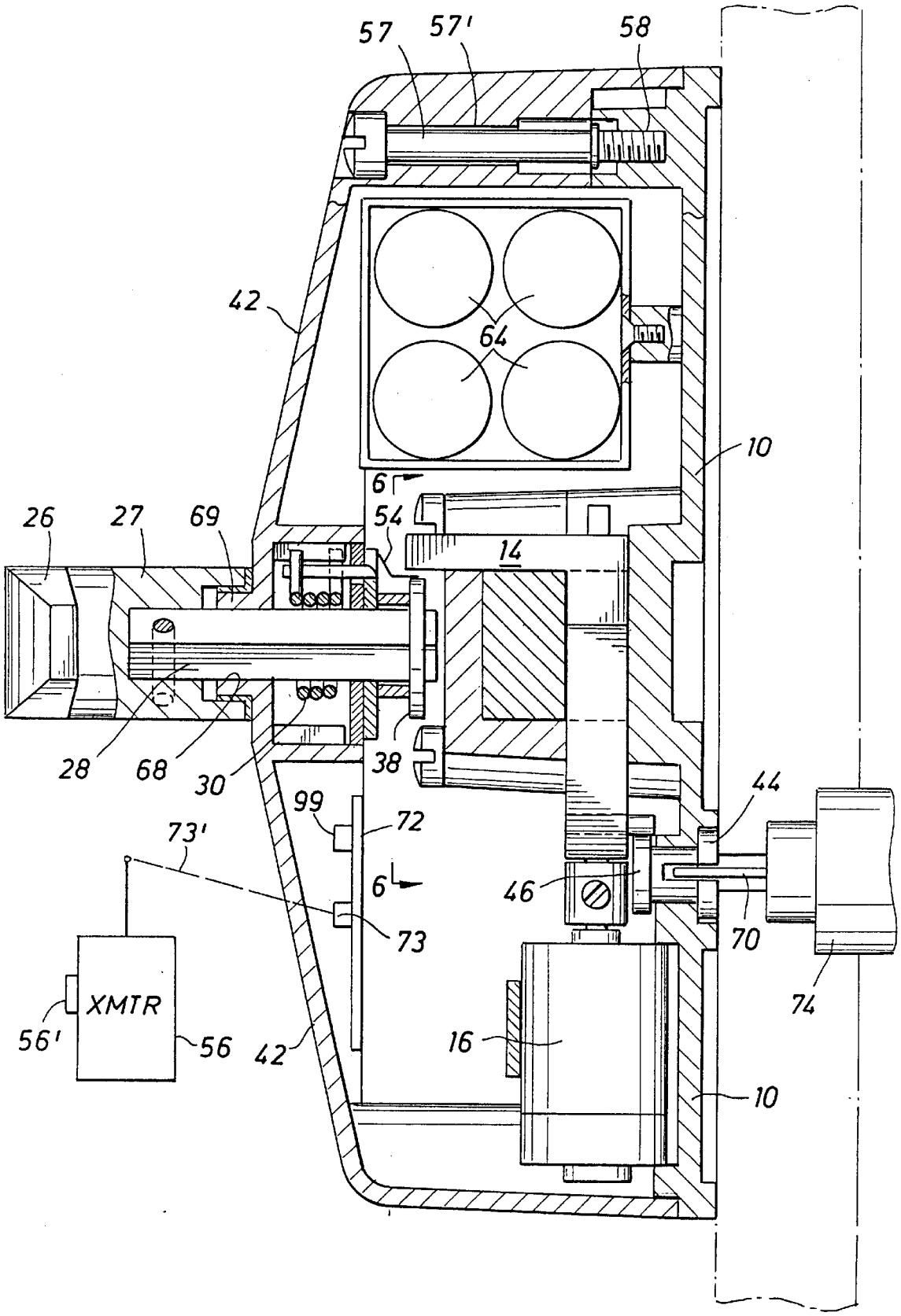
FIG. 3 is an edge-wise sectional view showing both interior and exterior manual operation means.

FIG. 3 is an edgewise view of the lock 9. As shown in FIG. 3 a lock housing cover 42 is releasably connected to the base plate 10 with threaded screws 57 that extend through openings 57' in cover 42 to engage threadedbores 58. A power supply preferably in the form of four "AA" batteries 64 is mounted to base plate 10 to power a receiver 73 and energize the electric motor 16 in accordance with a control circuit 99. An ON-OFF power switch 66 (see FIG. 1) is mounted adjacent a circuit board 72 in the cover housing 42, and is electrically connected between the batteries 64 and the circuit board 72. Setting the switch 66 to the OFF position induces electric moving means to disengage the blocking bar 14 from latch 12 placing door in unlocked condition. Setting switch 66 to the ON position energizes the electric moving means to urge the blocking bar 14 to engage the notch 13 in the latch 12 as previously described, placing door in a locked condition. The circuit board 72 includes the receiver 73 for receiving a wireless energy signal, illustrated conceptually with a broken line 73' and preferably a radio signal of a predetermined frequency, from a portable transmitter 56, as shown in FIG. 3. The wireless energy signal induces the control circuit 99, which is preferably mounted on the circuit board 72, to deliver the control signal to motor 16 which controls operation of motor 16. In this manner, control circuit induces the electric moving means to move the blocking bar 14 to disengage the notch 13 in the latch 12 for a predetermined time upon receipt of the wireless energy signal 73' from the transmitter 56, thereby allowing door to be opened.

Attention is again directed to FIGS. 1 and 2. When door is closed a magnetic reed switch 48 mounted in the cover housing 42 comes into alignment with a magnet 52 embedded in strike plate 50. Upon receipt of signal from magnetic reed switch 48, the control circuit 99 thereafter induces electric moving means to position the blocking bar 14 into the notch 13 in the latch 12 thereby locking door.

It is emphasized that the blocking bar 14 interacts directly with the door latch 12 to provide the desired door "locked" and "unlocked" status. With the lock 9 in the "unlocked" state, the door can be open or closed by simply pulling or pushing, respectively, due to the bevels 12' interacting with the striker plate 50. Operation of the unlocked door does not require the operation of levers or knobs.

MANUAL OPERATION

As indicated in FIGS. 3, 4 and 5, the lock 9 further includes means for disengaging the blocking bar 14 from the notch 13 in the latch 12 so that door can be manually opened from the interior side of door without electrical power. A typical lever type handle 26 extends ninety degrees outwardly on a preferably cylindrical body 27 concentric with the axis about which it rotates, and further extends through the lock housing cover 42. The handle 26 includes a square interior shaft 28 which extends through a circular opening 68 in a flanged portion 69 of the housing cover 42, permitting rotation of the handle 26 and the shaft 28 relative to the cover 42 and the base plate 10. A lever return spring 30 functions to return lever to the neutral position when the lever is released.

Figure 6:
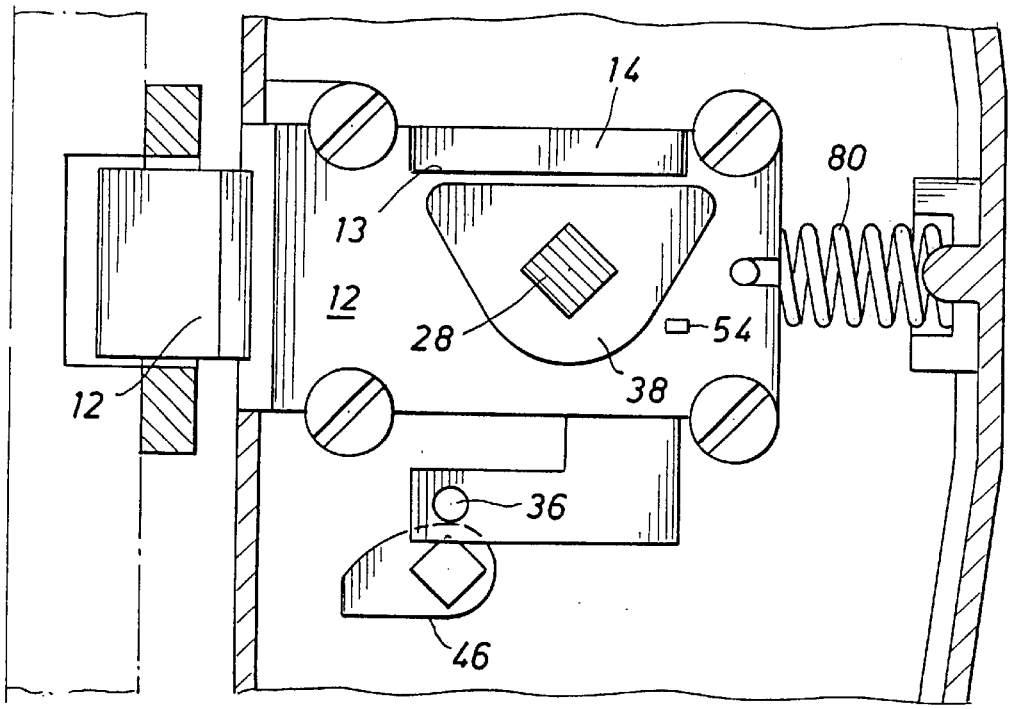
FIG. 6 is detail of latch with latch blocking bar seated and engaged within square notch in latch, in relation to parts of the manual moving means in the neutral or rest position.
Figure 7:
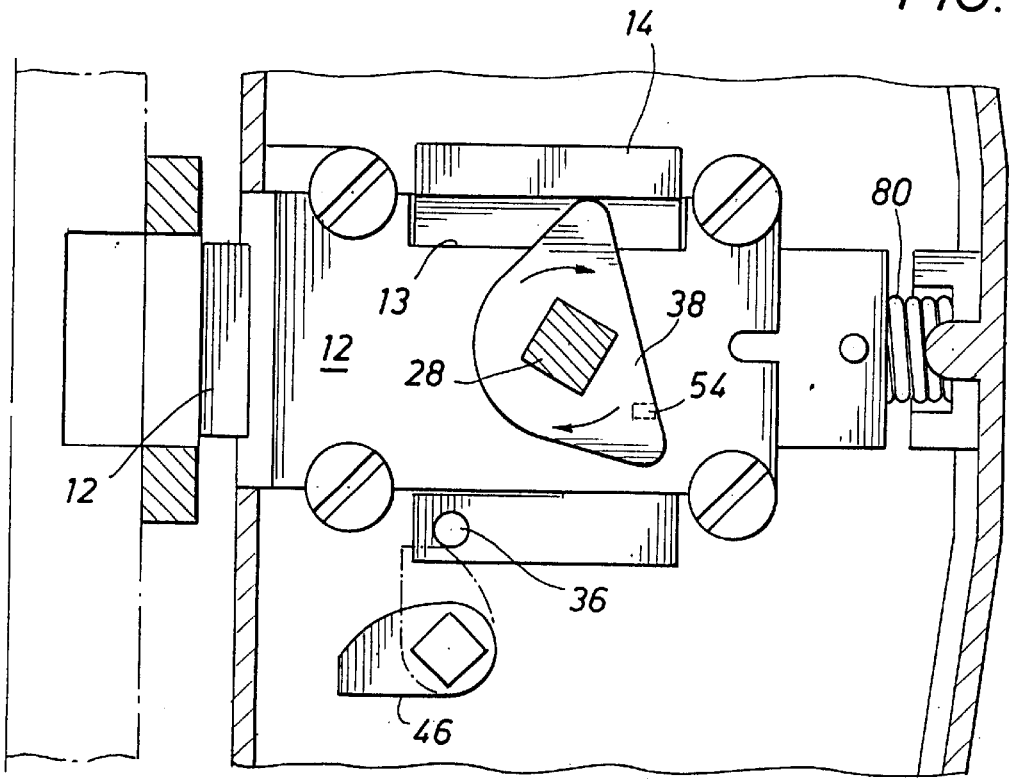
FIG. 7 is detail of manual moving means having disengaged blocking bar from square notch in latch, allowing latch to retract into housing as door is being opened.

FIGS. 6 and 7 are views in the same orientation as FIGS. 1 and 2, but show elements associated with the manual operation of the lock. A lever shaft cam 38 is positioned on square shaft 28 so as to engage the blocking bar 14 as shown in FIGS. 6 and 7. Referring to FIG. 6, while the lever 26 is at rest or neutral position, the lever shaft cam 38 allows the blocking bar 14 to seat in the rectangular notch 13 of the latch 12. Now referring to FIG. 7, depressing the lever handle 26 will rotate the lever shaft 28 and the attached lever shaft cam 38 so as to disengage the blocking bar 14 from the notch 13 in the latch 12 thereby unlocking door. Simultaneously, manual rotation of the lever 26 and attached cam 38 depresses a micro switch 54 signaling the circuit board 72 to induce electrical moving means to the disengaged or unlocked position of the blocking bar 14, thereby allowing the latch 12 to retract into the control housing 34 so that the door can close. When door is fully closed, the magnetic reed switch 48 mounted in the housing cover 42 is aligned with the magnet 52 embedded in the strike plate 50. Closing of the switch 48 signals the control circuit 72 of a "door closed" status thereby inducing the electrical moving means to the engaged or locked position as previously described.

Those of ordinary skill in the art will appreciate that the handle 26 is capable of rotation in a clockwise as well as counterclockwise direction. In this manner the door lock 9 is adaptable to doors that are hinged on either left or right hand side, simply by rotating the lock 9 one hundred eighty degrees and moving the lock 9 adjacent the appropriate edge of door.

KEY OPERATION

Referring again to FIG. 3, the door lock 9 further includes a means for enabling manual disengagement of the blocking bar 14 by means of a key inserted from the exterior side of the door. Thus, a standard type key locking cylinder 74 is mounted in a bore formed in the door for operation with a key (not shown). The key locking cylinder 74 includes shaft, commonly referred to as a tailpiece 70, that extends through a flange in the base plate 10 and is connected to a tailpiece adapter 44 A tailpiece adapter cam 46 is attached to the tailpiece adapter 44 to provide movement of the blocking bar 14. Rotation of the key in the lock cylinder 74 induces rotation of the tailpiece 70, the tailpiece adapter 44 and the tailpiece adapter cam 46. As illustrated in FIGS. 6 and 7, rotation of the tailpiece adapter cam 46 from neutral position will engage a roll pin 36 which extends outwardly from the blocking bar 14. Rotation of key will cause rotation of the tailpiece 70, the tailpiece adapter 44, and the tailpiece adapter cam 46 which will induce the blocking bar 14 to disengage from the notch 13 in latch 12 thereby unlocking door.

REMOTE OPERATION

Elements required to operate the lock 9 remotely were introduced in section 3 of this disclosure. The remotely controlled operation of door lock 9 will now be described in detail with reference to FIGS. 1, 2, 3, and 5. Initially, the setting of power switch 66 to the ON position induces control circuit 72 to send signal to the motor 16 that moves the blocking bar 14 via the shaft 18, nut 20 and springs 22, from the disengaged or unlocked position (as shown in FIGS. 2 and 5) to the engaged or locked position (as shown in FIGS. 1 and 3). When it is desirable to permit access through door, an operator grasps the portable transmitter 56, places his/her thumb on transmitter button 56' and depresses button to transmit a radio signal of predetermined frequency to door lock 9. The transmitted signal is then received by the receiver 73 on the circuit board 72. When the signal is received, the control circuit 99 sends a control signal to the motor 16, which outputs a torque to the shaft 18 for a predetermined time. The torque applied to shaft 18 is transferred by the engaging threads 19 of shaft 18 and nut 20 into linear motion within the opening 62 of the blocking bar 14. Action of nut 20 compresses one of the springs 22, which, in turn, applies a reactive force to the blocking bar 14 thereby moving blocking bar to disengagement with the rectangular notch 13 in the latch 12. This unlocks the door as shown in FIGS. 2 and 5. After a predetermined time period, the control circuit 99 confirms the "door closed" status by alignment of magnetic reed switch 48 with magnet 52 embedded in strike plate 50. Upon confirmation of "door closed" status, control circuit 99 signals motor 16, reversing shaft rotation to move the blocking bar 14 into engagement with the square notch in the latch 12 thereby locking door as shown in FIGS. 1 and 3.

SUMMARY

From the foregoing, it will be seen that this invention is well adapted to attain all the ends and objects set forth above, together with other advantages that are obvious and inherent to this apparatus and structure.

It will be understood that certain features and subcombinations are of utility and may be employed without reference to other features and subcombinations. This is contemplated by and within the scope of the claims.

Because many possible embodiments may be made of the invention without departing from the scope thereof, it is to be understood that all matter set forth herein or shown in the accompanying drawings is to be interpreted as illustrative and not in a limiting sense.

What is claimed is:

1. A door lock comprising:

(a) a lock housing for mounting to an inner face of a door adjacent the edge;

(b) a spring latch with two beveled faces moveable within said housing between extended and retracted positions;

(c) a spring latch blocking bar moveable within said housing, in a path perpendicular to said spring latch, with (i) one position engaging said latch at a notch within said latch thereby restricting retraction into said lock housing, and (ii) a second position disengaging said latch at said notch thereby permitting retraction into said housing;

(d) electric moving means within said housing for moving said latch blocking bar under electrical power between its engaged and disengaged positions, the electric moving means comprising (i) an electric motor connected to said housing;

(ii) an output shaft having external threads and connected to said motor wherein said motor produces a torque in said output shaft, and the output shaft extends into a longitudinal opening in said blocking bar;

(iii) a power supply connected to said housing for energizing said motor;

(iv) a nut having internal threads which engage said external threads of said shaft, wherein said nut is disposed within said longitudinal opening and about said output shaft for slidable engagement with walls of said longitudinal opening, and the engagement of said nut preventing rotation relative to said blocking bar, and (v) a pair of helical springs disposed in said opening on opposing sides of said nut between said nut and opposing ends of said opening, whereby torque applied to said output shaft will apply a force to said nut via the respective threads which transfers the force to said blocking bar via the helical springs to move said blocking bar between its engaged and disengaged position with said latch;

(e) means mounted within said housing for receiving a wireless energy signal and controlling the operation of said electrical moving means with a control signal triggered by the wireless energy signal to move said blocking bar from said engaged position to said disengaged position, hold said blocking bar to its disengaged position for a predetermined time period, and then return said blocking bar to its engaged position;

(f) portable means for transmitting the wireless energy signal to said receiving and controlling means; and (g) a latch receiving member for mounting to a door opening frame adjacent said lock housing for engaging said spring latch to urge it to its retracted position as the door is being opened or closed and receiving said spring latch in its extended position when a door is fully closed within a door opening frame.

2. The door lock of claim 1, wherein the moving means includes;

(a) an electric motor connected to said housing for producing an output torque upon receipt of the control signal from the receiving and controlling means;

(b) a power supply connected to said lock housing for energizing said motor; and (c) linkage means for converting the output torque of said motor into movement of said blocking bar between the engaged and disengaged position with said latch along a linear path defined by said lock housing.

3. The door lock of claim 2, further comprising a switch disposed between said electric motor and the power supply for opening a circuit between said motor and said power supply.

4. The door lock of claim 3, wherein the receiving and controlling means sends a signal to said motor for moving said blocking bar to its disengaged position with said latch when the switch is set to an OFF position.

5. The door lock of claim 1, wherein the receiving and controlling means comprises:

(a) a receiver tuned to a frequency range within which the wireless energy signal is transmitted; and (b) a control circuit operatively connected between the receiver and the moving means for inducing said moving means to move said blocking bar to its disengaged position for a predetermined time period upon receipt of the wireless energy signal from the transmitting means enabling a door to be opened, the control circuit thereafter moving said blocking bar to its engaged position when a door is fully closed.

6. The door lock of claim 1, wherein the wireless energy signal is a radio frequency signal.

7. The door lock of claim 1 wherein said power supply is at least one electric storage battery.

8. The door lock of claim 1 further comprising:

(a) a reed switch mounted in said housing;

(b) a magnet embedded in said latch receiving member; wherein (c) said reed switch and said magnet are aligned when said door is closed thereby generating a signal indicative of said door being closed.

9. The door lock of claim 1 further comprising means within said housing for yieldably urging said blocking bar to its disengaged position independently of said electrical moving means.

10. The door lock of claim 8 further comprising mechanical means for manually moving said blocking bar from its engaged position to its disengaged position so that a door can be opened without electrical power.

11. The door lock of claim 10 wherein said mechanical means comprises a lever handle which, when turned, moves said blocking bar to said disengaged position.

12. The door lock of claim 10 wherein said mechanical means comprises a key lock mechanism, wherein rotation of a key in said key lock mechanism moves said blocking bar to said disengaged position.

13. A door lock comprising:

(a) a lock housing for mounting to an inner face of a door adjacent the edge;

(b) a spring latch;

(c) a spring latch blocking bar moveable within said housing, in a path perpendicular to said spring latch, with (i) one position engaging said latch at a notch within said latch thereby restricting retraction into said lock housing, and (ii) other position disengaging said latch at said notch thereby permitting retraction into said housing;

(d) means within said housing for moving said latch blocking bar between its engaged and disengaged positions, the means for moving comprising (i) an electric motor connected to said housing;

(ii) an output shaft having external threads and connected to said motor wherein said motor produces a torque in said output shaft, and the output shaft extends into a longitudinal opening in said blocking bar;

(iii) a power supply connected to said housing for energizing said motor;

(iv) a nut having internal threads which engage said external threads of said shaft, wherein said nut is disposed within said longitudinal opening and about said output shaft for slidable engagement with walls of said longitudinal opening, and the engagement of said nut preventing rotation relative to said blocking bar, and (v) a pair of helical springs disposed in said opening on opposing sides of said nut between said nut and opposing ends of said opening, whereby torque applied to said output shaft will apply a force to said nut via the respective threads which transfers the force to said blocking bar via the helical springs to move said blocking bar between its engaged and disengaged position with said latch; and (e) a latch receiving member for mounting to a door opening frame adjacent said lock housing for engaging said spring latch to urge it to its retracted position as the door is being opened or closed and receiving said spring latch in its extended position when a door is fully closed within a door opening frame.

14. The door lock of claim 13 wherein said means for moving said latch blocking bar comprises a lever handle which, when rotated, causes said blocking to be moved to said disengaged position.

15. The door lock of claim 13 wherein said means for moving said latch blocking bar comprises a key lock cylinder which, when rotated, causes said blocking bar to be moved to said disengaged position.

* * * * *